US011458376B2

(12) United States Patent
Jaques et al.

(10) Patent No.: US 11,458,376 B2
(45) Date of Patent: Oct. 4, 2022

(54) ALL SURFACE, COUNTER-WEIGHTED, TEETERING, FREE-STANDING, MOBILE FIELD SPORT SHOOTING TARGET DEVICE AND METHODS OF MAKING AND USING SAME

(71) Applicants: Curtis Jaques, Mountain Top, PA (US); Rodney Ridley, Quakertown, PA (US)

(72) Inventors: Curtis Jaques, Mountain Top, PA (US); Rodney Ridley, Quakertown, PA (US)

( * ) Notice: Subject to any disclaimer, the term of this patent is extended or adjusted under 35 U.S.C. 154(b) by 8 days.

(21) Appl. No.: 17/113,839

(22) Filed: Dec. 7, 2020

(65) Prior Publication Data

US 2022/0176218 A1 Jun. 9, 2022

(51) Int. Cl.

| | |
|---|---|
| ***A63B 63/00*** | (2006.01) |
| ***A63B 69/00*** | (2006.01) |
| *A63B 102/14* | (2015.01) |

(52) U.S. Cl.

CPC ..... *A63B 63/004* (2013.01); *A63B 69/0075* (2013.01); *A63B 2063/002* (2013.01); *A63B 2102/14* (2015.10)

(58) Field of Classification Search

CPC . A63B 22/14–18; A63B 63/00; A63B 63/004; A63B 67/06; A63B 2067/063; A63B 69/0075

See application file for complete search history.

(56) References Cited

U.S. PATENT DOCUMENTS

| | | | | | |
|---|---|---|---|---|---|
| 1,924,379 | A * | 8/1933 | Reese | A01M 1/02 | 43/122 |
| 2,453,565 | A * | 11/1948 | Barden | A63B 55/50 | 248/156 |
| 2,480,412 | A * | 8/1949 | King | A47G 29/1216 | 248/150 |
| 3,039,770 | A * | 6/1962 | Ferretti | A63B 69/0075 | 273/402 |
| 3,105,686 | A * | 10/1963 | Elsea | A63B 69/0075 | 235/61 PE |
| 3,305,234 | A * | 2/1967 | Cline et al. | F16B 2/185 | 24/270 |
| 3,319,958 | A * | 5/1967 | Bender | A63D 15/00 | 473/29 |
| 5,092,586 | A * | 3/1992 | Tuthill | A63B 22/18 | 482/146 |
| 8,821,322 | B1 * | 9/2014 | Jorgens | A63B 69/0075 | 473/417 |
| 9,926,119 | B1 * | 3/2018 | Honeycutt | A47B 91/06 | |
| 2002/0010041 | A1 * | 1/2002 | Pearson | A63B 63/083 | 473/479 |

* cited by examiner

*Primary Examiner* — Laura Davison
(74) *Attorney, Agent, or Firm* — James R. McDaniel

(57) ABSTRACT

A mobile, free standing field sport shooting target device, including a pole having a first end and a second end, wherein an opening is located at the first and second ends of the pole, a counter weight plate having a plurality of openings, wherein the counter weight plate is located adjacent to the first end of the pole, and a collar operatively connected to the first end of the pole, wherein the collar has a first end and a second end such that the counter weight plate is located adjacent to the first end of the collar and the collar is used to retain the counter weight on the first end of the pole, and wherein a distance between the first end of the pole and the second end of the collar can be adjusted.

18 Claims, 17 Drawing Sheets

FIG. 3
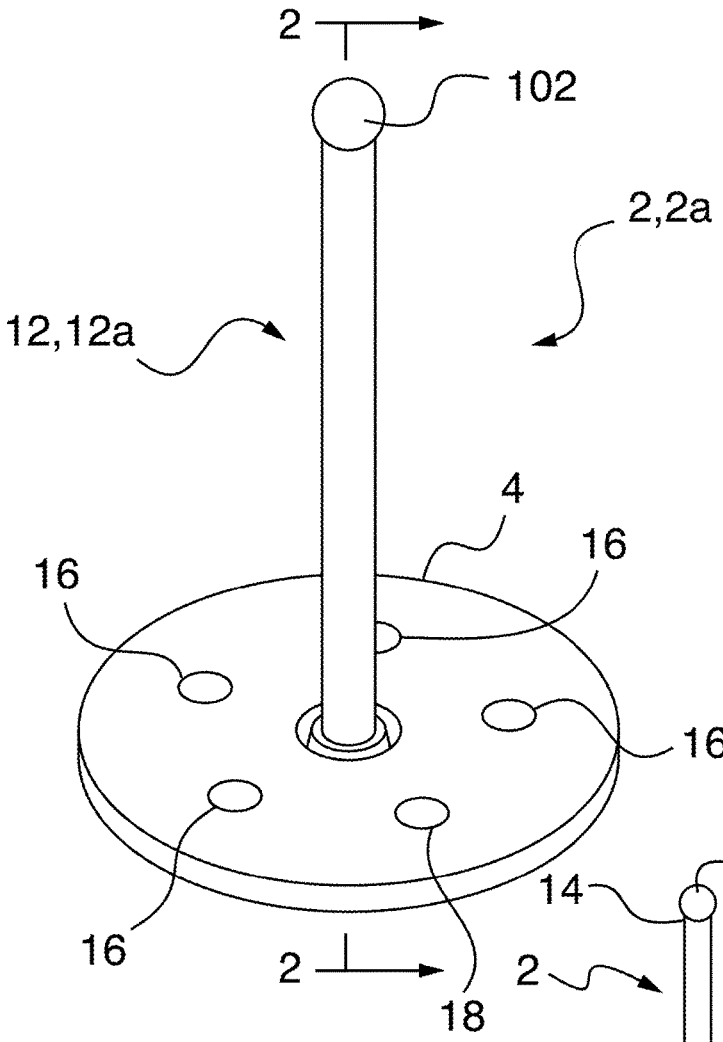
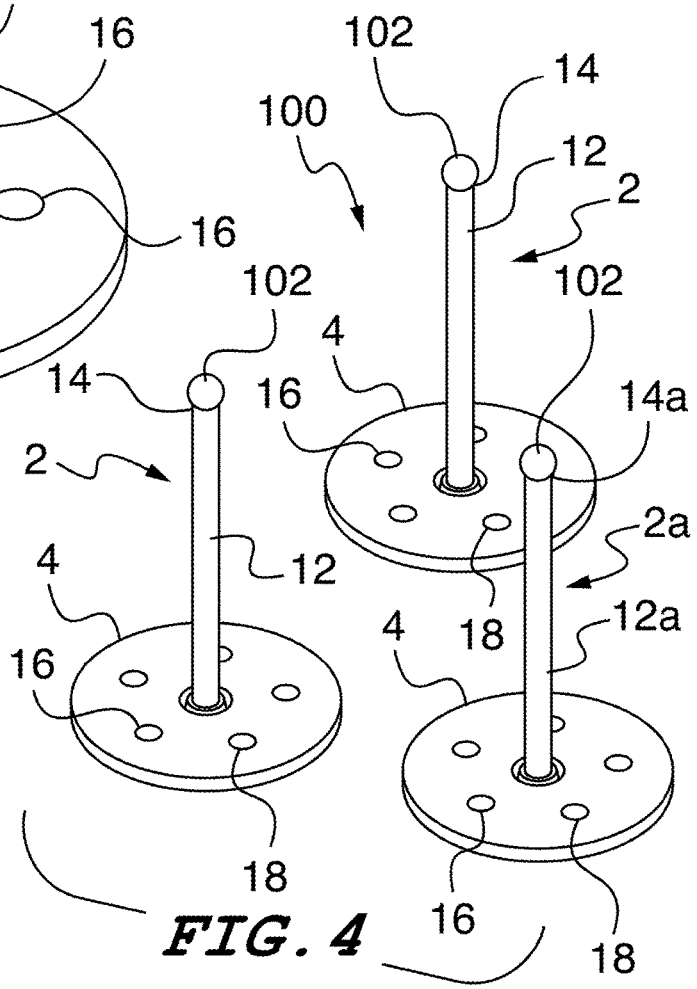
FIG. 4

ALL SURFACE, COUNTER-WEIGHTED, TEETERING, FREE-STANDING, MOBILE FIELD SPORT SHOOTING TARGET DEVICE AND METHODS OF MAKING AND USING SAME

FIELD OF THE INVENTION

The present invention is generally related to a mobile, free standing field sport shooting target device for use in such sports as lacrosse. The mobile, free standing field sport shooting target device can be used on all surfaces. Furthermore, the mobile, free standing field sport shooting target device is counter-weighted but is still able to teeter in order to allow the end user (player) to properly develop his/her shooting skills. The object of the mobile, free standing field sport shooting target device is to allow the player to try to knock a ball (such as a lacrosse ball) off of the mobile, free standing field sport shooting target device by using the force of a ball being propelled from a sporting implement such as a lacrosse stick that contacts the mobile, free standing field sport shooting target device. This requires the player to attempt to shoot down towards the pole (goalpole) holding the ball or shoot directly at the ball on the mobile, free standing field sport shooting target device in order to allow the end user (player) to properly develop his/her shooting skills. The mobile, free standing field sport shooting target device eliminates the need for a goalie to try and block the shots so that the player can safely practice and develop his/her shooting skills.

BACKGROUND OF THE INVENTION

Prior to the present invention, as set forth in general terms above and more specifically below, it is known, to employ various types of training devices to improve the shooting skills of an athlete such as a lacrosse player. It is known to use a goalie during the practicing of shooting skills such that the goalie may be placed in front of the goal to assist the player in improving the player's shooting skills. However, if the goalie is not that experienced in blocking shots and/or the player is not that experienced in shooting the ball at a goalie, the goalie may get inadvertently injured. While these and other various training devices used to improve the shooting skills of an athlete may have been generally satisfactory, there is nevertheless a need for a new and improved mobile, free standing field sport shooting target device for use in such sports as lacrosse.

It is a purpose of this invention to fulfill these and other needs in the art of training devices to improve the shooting skills of an athlete such as a lacrosse player in a manner more apparent to the skilled artisan once given the following disclosure.

The preferred mobile, free standing field sport shooting target device for use in such sports, as lacrosse, according to various embodiments of the present invention, offers the following advantages: ease of use; reduced cost; portability; lightness in weight; durability; compactness of the device; improved safety; improved shooting skills training characteristics; the ability to hear when the ball contacts the device; the ability to provide different heights of the device; the ability to allow the device to teeter; the ability to be free standing; provides a three-dimensional, functional bounce shooting target; provides a training tool for small sided lacrosse games; ease of packing the device; and ease of carrying the device. In fact, in many of the preferred embodiments, these advantages are optimized to an extent that is considerably higher than heretofore achieved in prior, known training devices used to improve the shooting skills of an athlete such as a lacrosse player.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which:

FIG. 3 is an isometric view of a mobile, free standing field sport shooting target device, constructed according to one embodiment of the present invention;

FIG. 4 is an isometric view of a plurality of mobile, free standing field sport shooting target devices, constructed according to one embodiment of the present invention;

DETAILED DESCRIPTION OF THE PREFERRED EMBODIMENTS OF THE INVENTION

Figure 1:
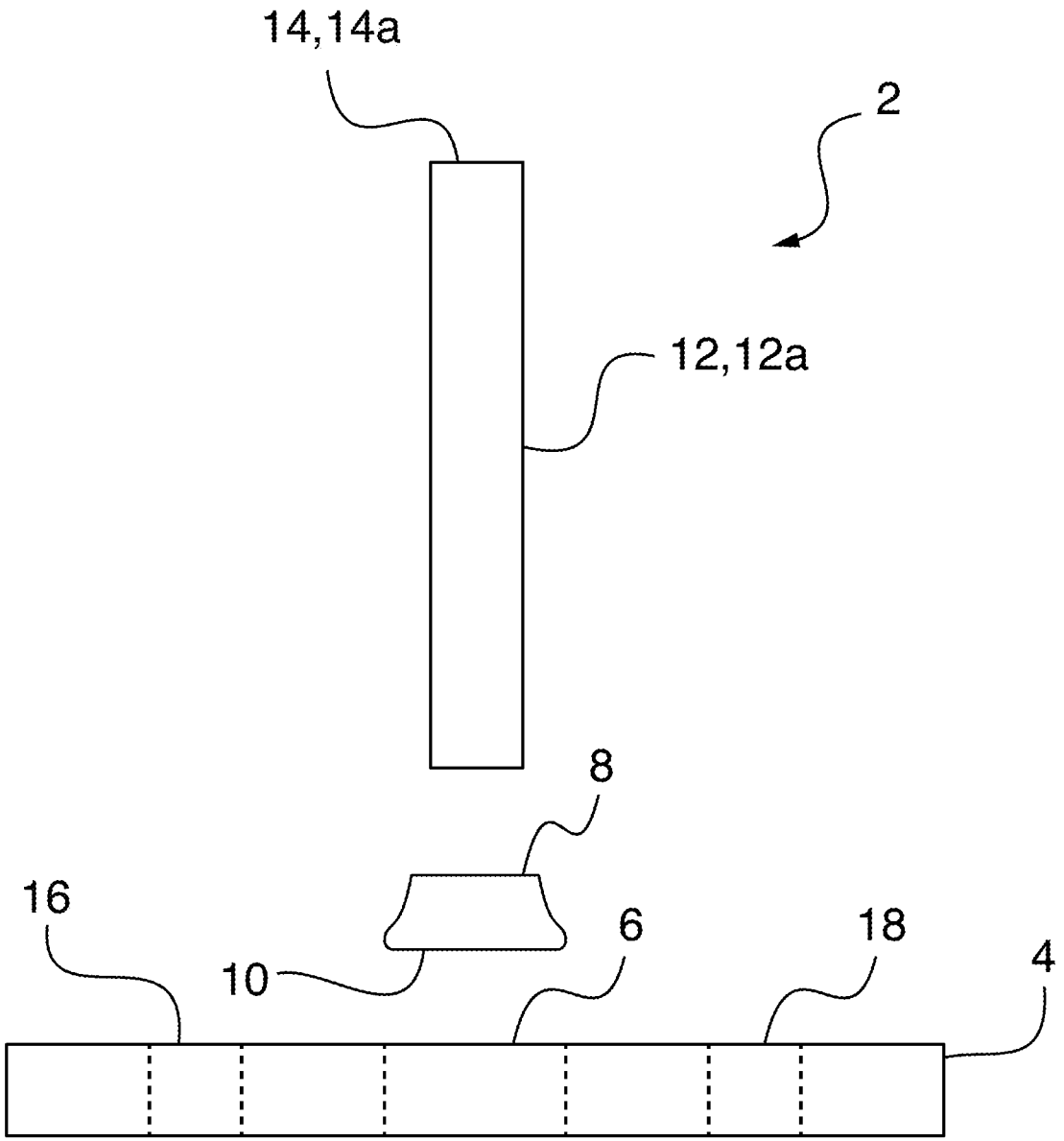
FIG. 1 is an exploded view of a mobile, free standing field sport shooting target device, according to one embodiment of the present invention.

Referring now to FIG. 1, there is illustrated a mobile, free standing field sport shooting target device (goalpole) 2 for use in such sports as lacrosse. The mobile, free standing field sport shooting target device 2 can be used on all sports playing surfaces. Furthermore, the mobile, free standing field sport shooting target device 2 is counter-weighted but is still able to teeter in order to allow the end user (player) to properly develop his/her shooting skills. As will be explained hereinafter in greater detail, the mobile, free standing field sport shooting target device 2 allows the player to try to knock a ball 102 (FIG. 3) (such as a lacrosse ball) off of the mobile, free standing field sport shooting target device 2 by using the force a ball being propelled from a sporting implement such as a lacrosse stick that contacts the mobile, free standing field sport shooting target device 2.

As shown in FIG. 1, mobile, free standing field sport shooting target device 2 includes, in part, counter weight plate 4 having openings 6, 16 and 18, end cap 8 having flared end 10, and pole (goalpole) 12,12*a* having opening 14, 14*a*, respectively.

With respect to counter weight plate 4, counter weight plate 4 is used to retain mobile, free standing field sport shooting target device 2 in an upright position so that mobile, free standing field sport shooting target device 2 is not easily knocked over, as will be discussed in greater detail later. Preferably, counterweight plate 4 can be constructed of any suitable, durable, rigid, UV resistant, and high strength material. It is to be understood that counterweight plate 4 should have enough mass so that mobile, free standing field sport shooting target device 2 is retained in an upright position and is not easily knocked over, but can still move back and forth (teeter). Preferably, the counter weight plate 4 weighs from 5-10 pounds and has a diameter range of 12-16 inches. It is to be further understood that the counter weight plate 4 should also be able to be easily connected to the end cap 8 and the poles 12, 12*a* in order for use and for transport of mobile, free standing field sport shooting target device 2, as will be discussed in greater detail later.

A unique aspect of the present invention are openings 16 and 18 in counter weight plate 4. As will be discussed in greater detail later, in order to pack up and transport mobile, free standing field sport shooting target device 2, poles 12, 12*a* are removed from openings 6 in counter weight plate 4. Preferably, there will be four (4) longer poles 12 having a length range of 2.5-3.5 feet and two (2) shorter poles 12*a* having a length range of 1.25-1.75 feet (FIG. 4). As will be discussed in greater detail later, the four (4) longer poles 12 will be placed into openings 16 and the two (2) shorter poles 12*a* will be connected together and then placed in openings 18. In this manner, the mobile, free standing field sport shooting target device 2 can then be easily packed up and transported away from the practice surface after the shooting skills practice session has ended.

Regarding end cap 8, end cap 8 is placed over one end of pole 12 (and pole 12*a*) in order to allow pole 12 (and pole 12*a*) to teeter within the counter weight plate 4, as will be discussed in greater detail later. Preferably, end cap 8 can be constructed of any suitable, durable, flexible, UV resistant, and high strength material. It is to be understood that end cap 8 includes a conventional opening (not shown) at one end so that end cap 8 can be placed over one end of pole 12 (and pole 12*a*) and that the other end of end cap 8 includes a flared end 10. It is to be understood that the diameter of end cap 8 and flared end 10 should be large enough such that when end cap 8 is attached to pole 12 (and pole 12*a*), end 8 will properly retain pole 12 (and pole 12*a*) within opening 6, allow pole 12 (and pole 12*a*) to teeter within opening 6, and not allow pole 12 (and pole 12*a*) to easily move up and down within opening 6.

Another unique aspect of the present invention is the addition of flared end 10 on end cap 8. As will be discussed in greater detail later, when end cap 8 is placed over one end of pole 12 (and pole 12*a*) and the end of pole 12 (and pole 12*a*) containing end cap 8 is placed in counter weight plate 4, flared end 10 will allow pole 12 (and pole 12*a*) to teeter or rock back and forth so that when pole 12 (and pole 12*a*) is contacted by a ball that has been thrown at pole 12 (and pole 12*a*), a ball located on the top of pole 12 (and pole 12*a*) in opening 14 (opening 14*a*) (FIG. 4) will become dislodged from the other end of pole 12 (and pole 12*a*). It is to be understood that flared end 10 can be constructed on the end of end cap 8 by conventional material forming techniques such as forming, molding, adhesives, fasteners or the like. The important aspect of flared end 10 being that it must be large enough to retain pole 12 (and pole 12*a*) in opening 6 and to allow pole 12 (and pole 12*a*) to teeter within the opening 6 of counter weight plate 4, as will be discussed in greater detail later. It is to be understood that the poles 12 and 12*a* could instead include a tapered end (not shown) that resembles the flared end 10. In this manner, the end cap 8 could be eliminated and the poles 12 and 12*a* having a tapered end could be used instead.

With respect to poles 12 and 12*a*, poles 12 and 12*a* are used to hold the ball in opening 14 and 14*a*, respectively, at a desired distance off of the practice surface so that the player can practice shooting at the ball and at the poles 12 and 12*a*, as will be discussed in greater detail later. Preferably, poles 12 and 12*a* can be constructed of any suitable, durable, rigid, UV resistant, and high strength material that is capable of creating a sound when contacted by an object, as will be discussed in greater detail later. As will be discussed in greater detail later, poles 12 and 12*a* can be constructed of a variety of lengths with the preferable lengths being 2.5-3.5 feet for poles 12 and 1.25-1.75 feet for poles 12*a*. Also, it is to be understood that the diameter of poles 12 and 12*a* should be large enough to properly retain a ball such as a lacrosse ball in opening 14 and 14*a*, respectively. It is to be further understood that the length of the shorter poles 12*a* should be one-half of the length of the longer poles 12 so that the poles 12 and 12*a* can be easily stored and transported, as will be discussed in greater detail later. Preferably, the diameter of poles 12 and 12*a* is between 1-1.5 inches. Finally, it is to be understood that poles 12 and 12*a* should be constructed so that when a ball contacts poles 12 and 12*a*, an audible sound will be created that can be easily heard by the player using the mobile, free standing field sport shooting target device 2, as will be discussed in greater detail later.

Figure 2:
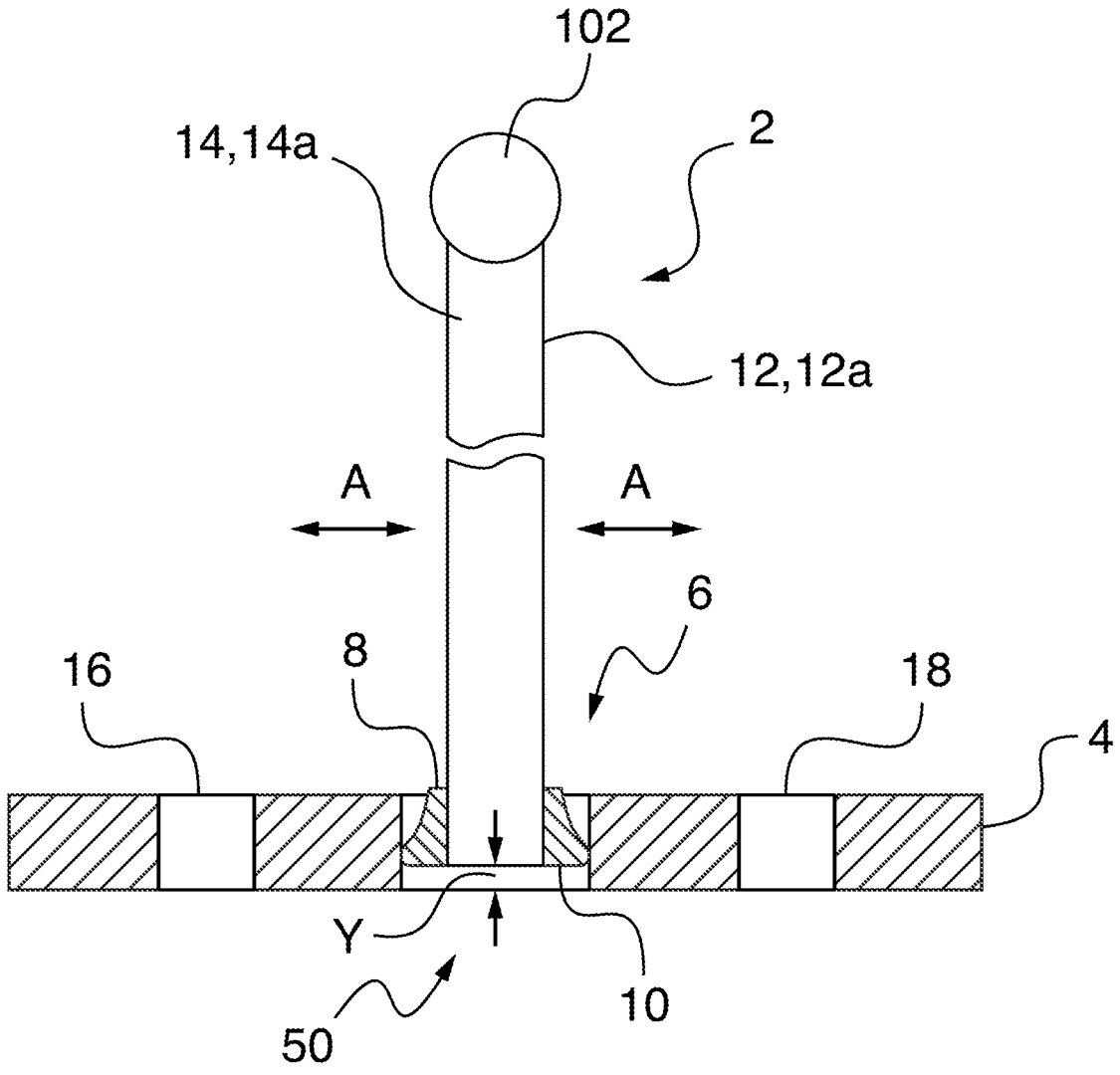
FIG. 2 is a cross-sectional view of a mobile, free standing field sport shooting target device, taken along lines 2-2 of FIG. 3, constructed according to one embodiment of the present invention.

With reference now to FIG. 2, the placement of poles 12 and 12*a* within counter weight plate 4 will be discussed. As shown in FIG. 2, end cap 8 has been conventionally placed on one end of pole 12, 12*a* and end cap 8 and pole 12, 12*a* have been placed in opening 6 of a counter weight plate 4.

It is to be understood that while only one pole 12, 12*a* is illustrated, the discussion applies equally to both poles 12 and 12*a*. As can be seen in FIG. 2, the ends of pole 12, 12*a* and flared end 10 of end cap 8 are located within opening 6 of counter weight plate 4 so that a space 50 is created between the flared end 10 of end cap 8 and the bottom of counter weight plate 4. Preferably, space 50 can range from ¼ inch to ¾ inch along the direction of arrow Y. The important factor of the size of space 50 being that space 50 should allow poles 12 and 12*a* to teeter within opening 6 of counter weight plate 4 by allowing poles 12 and 12*a* to move in the direction of arrows A-A.

Regarding FIGS. 3 and 4, there are illustrated mobile, free standing field sport shooting target device 2 and 2*a*. As will be discussed in greater detail later, mobile, free standing field sport shooting target device 2*a* is similar to mobile, free standing field sport shooting target device 2 except that mobile, free standing field sport shooting target device 2*a* contains an opening 14*a* and a shorter pole 12*a*. Otherwise, mobile, free standing field sport shooting target device 2 and mobile, free standing field sport shooting target device 2*a* are constructed in substantially the same manner. Also, as shown in FIGS. 3 and 4, a conventional sporting ball such as a lacrosse ball 102 is now located on top of pole 12 in opening 14 in mobile, free standing field sport shooting target device 2 and on top of pole 12*a* in opening 14*a* in mobile, free standing field sport shooting target device 2*a*.

Another unique aspect of the present invention is mobile, free standing field sport shooting target system 100, as shown in FIG. 4. It is to be understood that mobile, free standing field sport shooting target system 100 will include at least two (2) mobile, free standing field sport shooting target devices 2 and at least one (1) mobile, free standing field sport shooting target device 2*a*. The mobile, free standing field sport shooting target devices 2 and 2*a*, preferably, will be placed on the conventional playing practice surface (not shown) in a triangular pattern so that the shorter mobile, free standing field sport shooting target device 2*a* is located in front of the two (2) taller mobile, free standing field sport shooting target devices 2, as will be discussed in greater detail later. It is to be understood that while a triangular pattern is shown, other similar patterns can also be used and still provide the desired shooting skill training capabilities.

Figure 5:
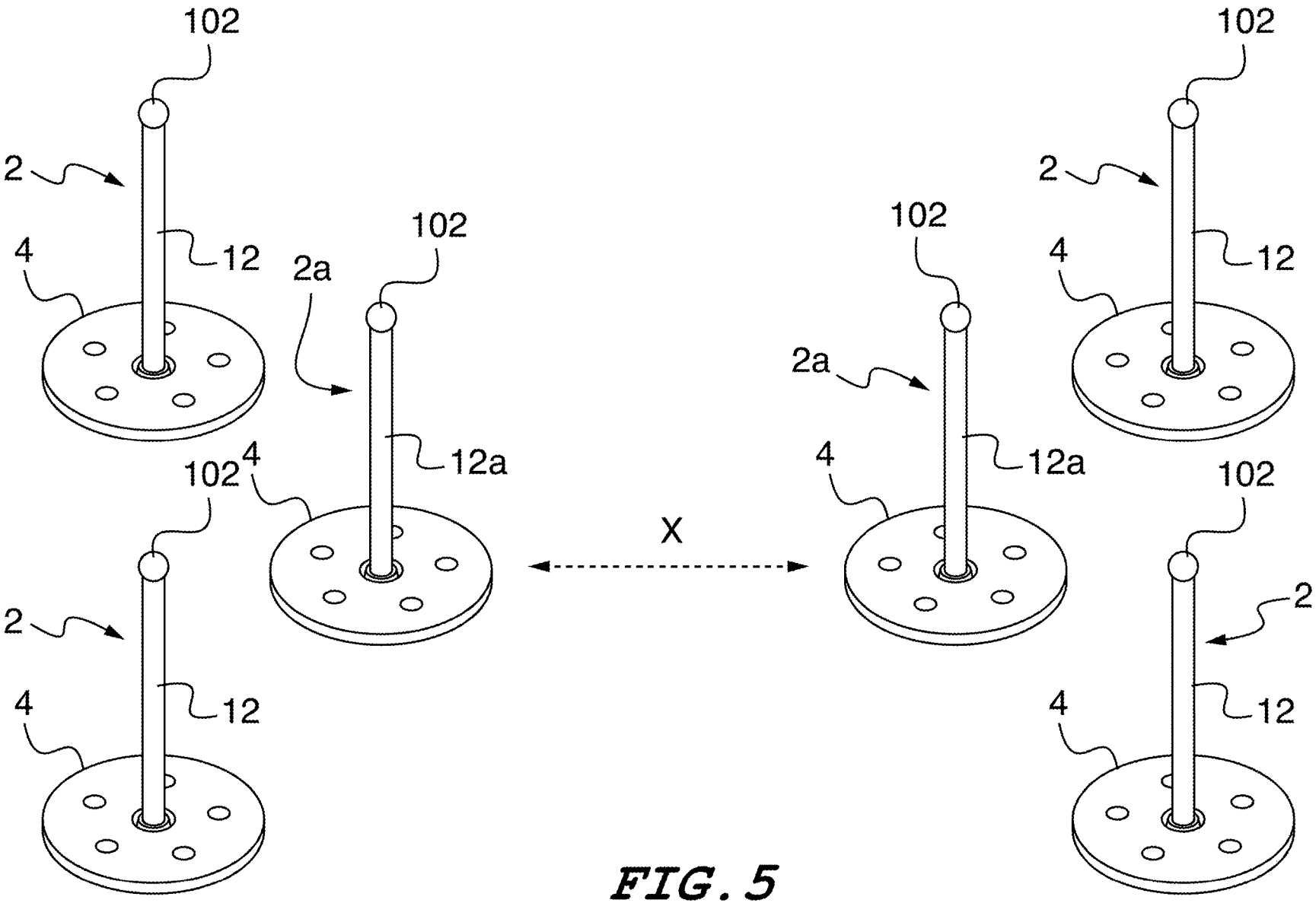
FIG. 5 is an example of a layout of the plurality of mobile, free standing field sport shooting target devices on a practice surface, according to one embodiment of the present invention.

In order to set up mobile, free standing field sport shooting target system 100, attention is directed to FIG. 5. As shown in FIG. 5, at least two (2) mobile, free standing field sport shooting target systems 100 are set up a predetermined distance (X) from each other. Preferably, the distance (X) is from 15 to 30 yards. It is to be understood that mobile, free standing field sport shooting target systems 100 should be set up in a triangular manner, as previously discussed, so that the shorter mobile, free standing field sport shooting target devices 2*a* are closest to each other and the taller mobile, free standing field sport shooting target devices 2 are farthest from each other.

In order to properly utilize the setup of the mobile, free standing field sport shooting target systems 100, the player's objective is to knock the ball 102 off of the poles 12 and/or 12*a* by shooting a ball or other similar object (not shown) from a playing implement such as a lacrosse stick towards the poles 12 and/or 12*a*. It is to be understood that if the ball contacts the poles 12 and/or 12*a* with the proper amount of force, the poles 12 and/or 12*a* should teeter along the direction of arrows A-A (FIG. 2), as discussed earlier, which should cause the ball(s) 102 to become dislodged from poles 12 and/or 12*a* and fall off of poles 12 and/or 12*a*. The first player or team to knock all of the balls 102 off of the opposing player's or team's mobile, free standing field sport shooting target system 100 is the winner.

Another unique aspect of the present invention is related to the teetering of poles 12 and 12*a*. In particular, in the sport of lacrosse, one of the main objects of the game is to shoot a ball (not shown) into the opponent's goal. There are many ways that the ball can be shot towards the opponent's goal including a direct shot at the goal, bouncing the ball towards the goal (the bounce shot) and/or skipping/sliding the ball towards the opponent's goal (the bounce shot). A skilled lacrosse player needs to be able to master all of these types of shots. The present invention provides the lacrosse player with the opportunity to practice a variety of such shots because the present invention allows the player to practice direct shots at the ball 102 placed on top of poles 12 and 12*a*. The present invention also allows the player to practice shooting down on the mobile, free standing field sport shooting target devices 2 and 2*a*. Finally, the shooting down on the mobile, free standing field sport shooting target devices 2 and 2*a* provides the player with the opportunity to practice bouncing and/or skipping/sliding the ball.

A further unique aspect of the present invention is that the present invention highlights the three-dimensional skill development of the bounce shot. The prior known two-dimensional targets that hang in goals do not provide this functional and fundamental skill set of shooting for the lower corners.

A still further unique aspect of the present invention is that the mobile, free standing field sport shooting target devices 2 and 2*a* can also provide an audible sound that provides feedback to the end user/player to notify the end user/player that the ball (not shown) thrown by the end user/player actually did contact the mobile, free standing field sport shooting target device 2 and/or 2*a*. In particular, as discussed above, when a ball or other similar object (not shown) is propelled from a playing implement such as a lacrosse stick towards the poles 12 and/or 12*a*, if the ball contacts the poles 12 and/or 12*a* with the proper amount of force, the contact of the ball against the poles 12 and/or 12*a* should create an audible sound that the player can easily hear at a distance from the mobile, free standing field sport shooting target devices 2 and/or 2*a*. In this manner, the player can see that the ball 102 fell off of the mobile, free standing field sport shooting target devices 2 and/or 2*a* and can hear that the ball contacted the mobile, free standing field sport shooting target devices 2 and/or 2*a* in order to cause the ball 102 to fall off of the mobile, free standing field sport shooting target devices 2 and/or 2*a*.

Figure 6:
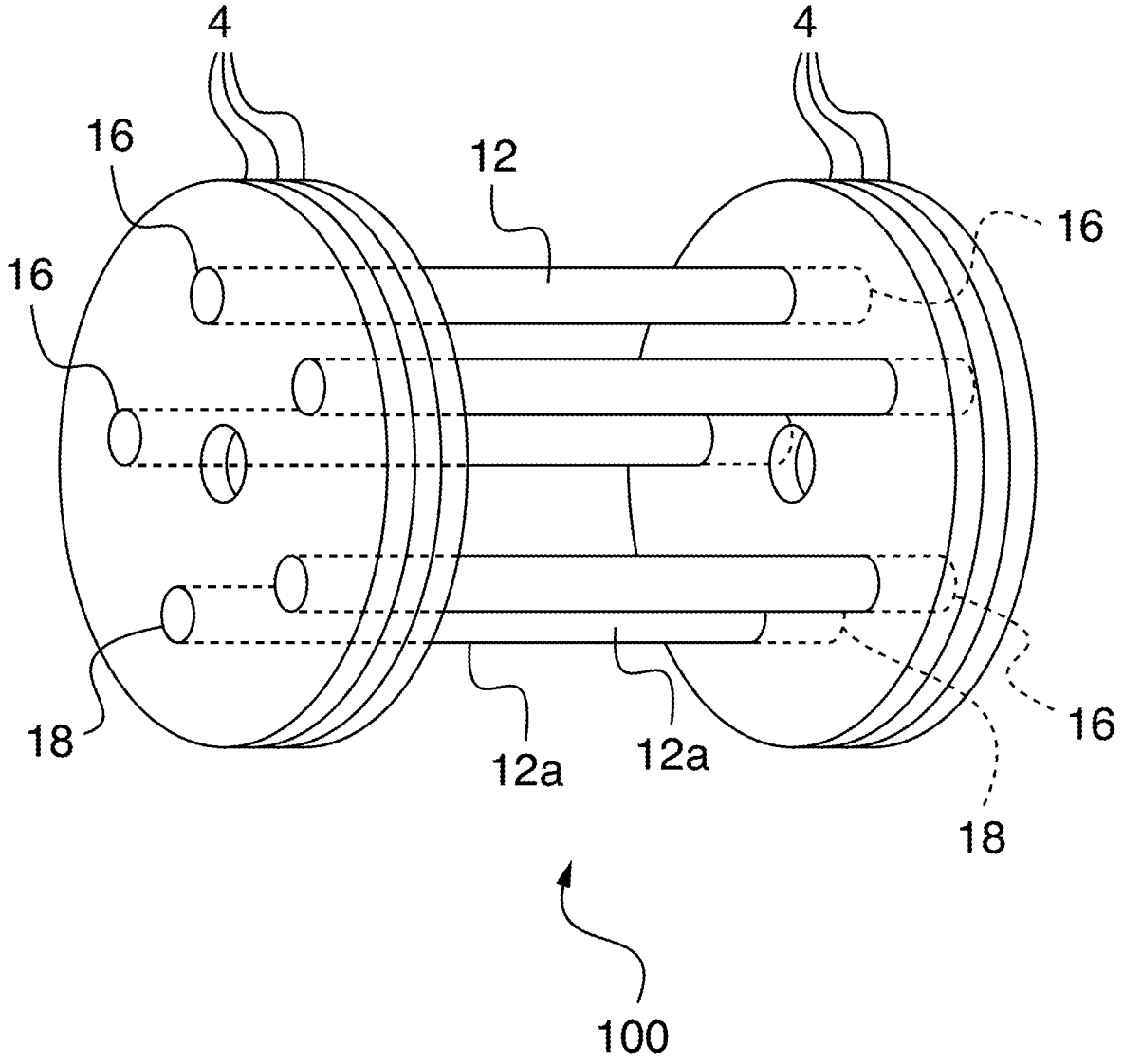
FIG. 6 is an isometric view of the plurality of mobile, free standing field sport shooting target devices being stored together for subsequent transportation, according to one embodiment of the present invention.
Figure 7:
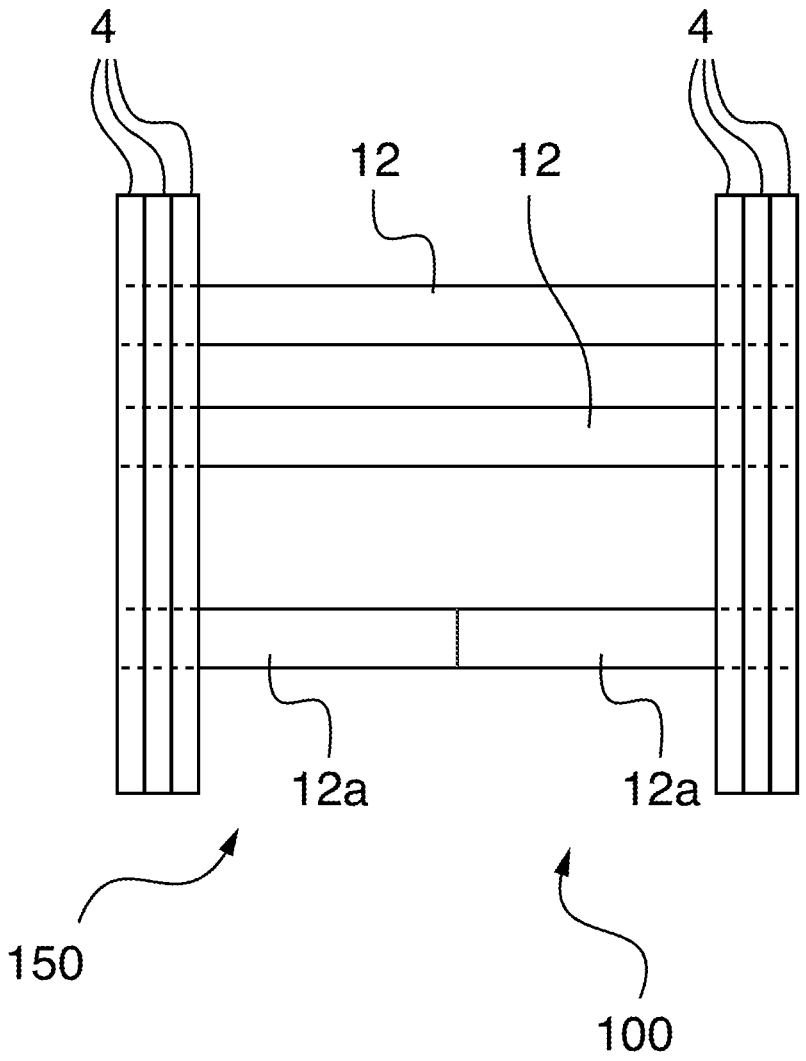
FIG. 7 is a side view of the plurality of mobile, free standing field sport shooting target devices being stored together for subsequent transportation, according to one embodiment of the present invention.

With respect to FIGS. 6 and 7, once the player(s) and/or teams have finished using the mobile, free standing field sport shooting target system 100, the mobile, free standing field sport shooting target system 100 can be taken apart, stored together and transported from the playing practice area. In this manner, poles 12 and 12*a* can be removed from counter weight plates 4. Shorter poles 12*a* can then be conventionally connected together to form one long pole. After the poles 12*a* have been connected together, counter weight plates 4 can be conventionally stacked together into two (2) stacks of three (3) counter weight plates 4, as shown in FIGS. 6 and 7. The poles 12 can be placed into openings 16 of counter weight plates 4. The connected poles 12*a* can be placed into the openings 18 of counter weight plates 4 to create a compact carrying case 150. It is to be understood that end caps 8 on one end of poles 12 and 12*a* should remain in place so that when poles 12 and 12*a* are placed in openings 16 and 18, respectively, the end caps 8 will assist in keeping the poles 12 and 12*a* properly retained within the stacks of counter weight plates 4.

A further unique aspect of the present invention is the packing up and transporting of mobile, free standing field sport shooting target system 100. As shown in FIGS. 6 and 7, after the player(s) and/or teams have finished using the mobile, free standing field sport shooting target system 100, the mobile, free standing field sport shooting target system 100 can be packed up into a compact carrying case 150 that is easily transportable from the playing practice area.

A still further unique aspect of the present invention is that the present invention provides a three-dimensional, functional bounce shooting target and training tool for small sided lacrosse games.

Figure 8:
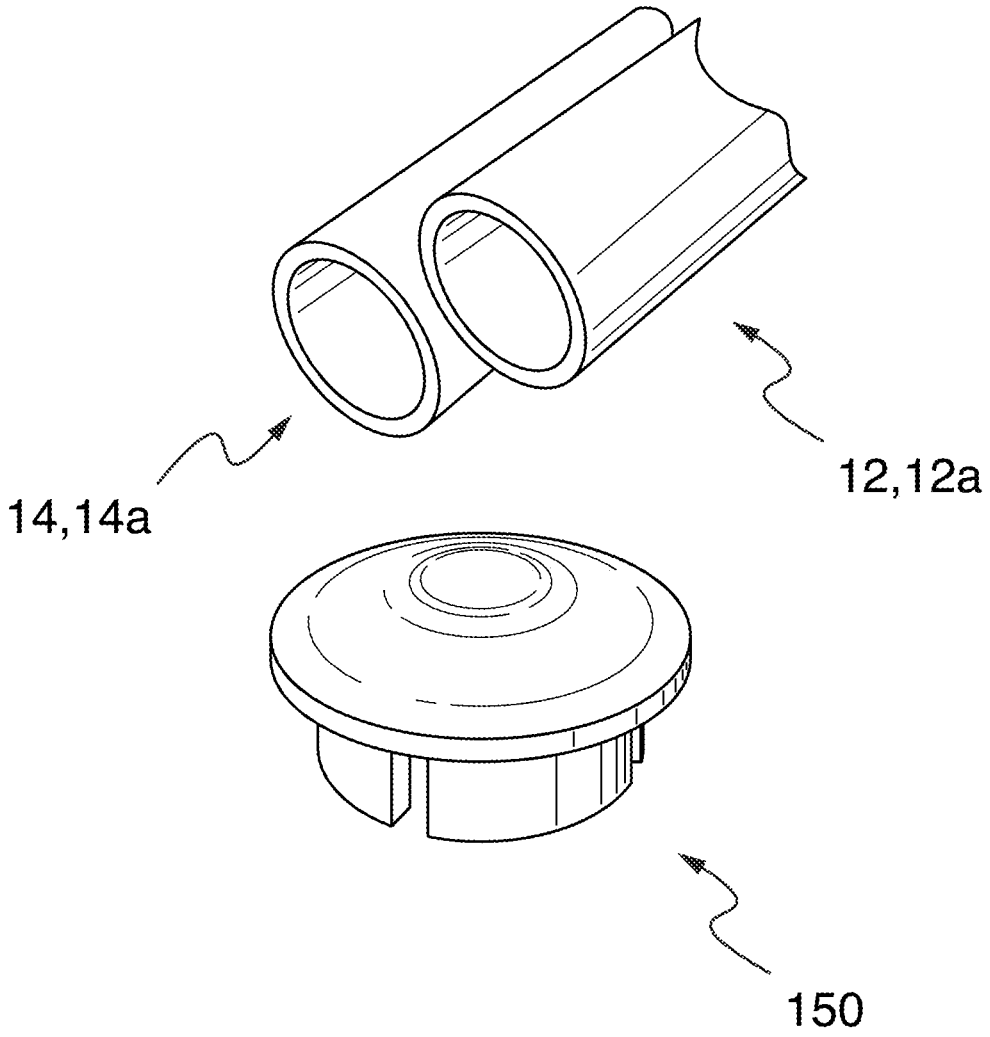
FIG. 8 is a schematic illustration of the goalpole and the goalpole end cap, according to another embodiment of the present invention.

With respect to FIG. 8, there is illustrated another embodiment of the goalpole 12, 12*a* which includes goalpole end cap 150. Preferably, goalpole end cap 150 is constructed of any suitable, durable, rigid, UV resistant, and high strength material. It is to be understood that goalpole end cap 150 is attached to one end of goalpole 12, 12*a* by conventional techniques such as adhesives, fasteners, or the like. A unique aspect of the present invention is that the use of goalpole end cap 150 allows goalpole 12, 12*a* to rock back and forth (teeter) on goalpole end cap 150 in a similar manner as discussed above with respect to FIGS. 1-5, as will be discussed in greater detail later.

With respect to FIGS. 9-18, there are illustrated various embodiments of creating the rocking back and forth (teetering) motion, as previously discussed. It is to be understood that pole (goalpole) 12,12*a* is constructed in a similar manner, as discussed above. For the sake of clarity, the ends of pole (goalpole) 12,12*a* wherein the ball 102 is located on openings 14, 14*a*, respectively, are not shown in FIGS. 9-18. However, it is to be understood that the pole (goalpole) 12,12*a* shown in FIGS. 9-18 is also capable of holding a ball 102 and can be used to practice a variety of such shots, as discussed above.

Figure 9:
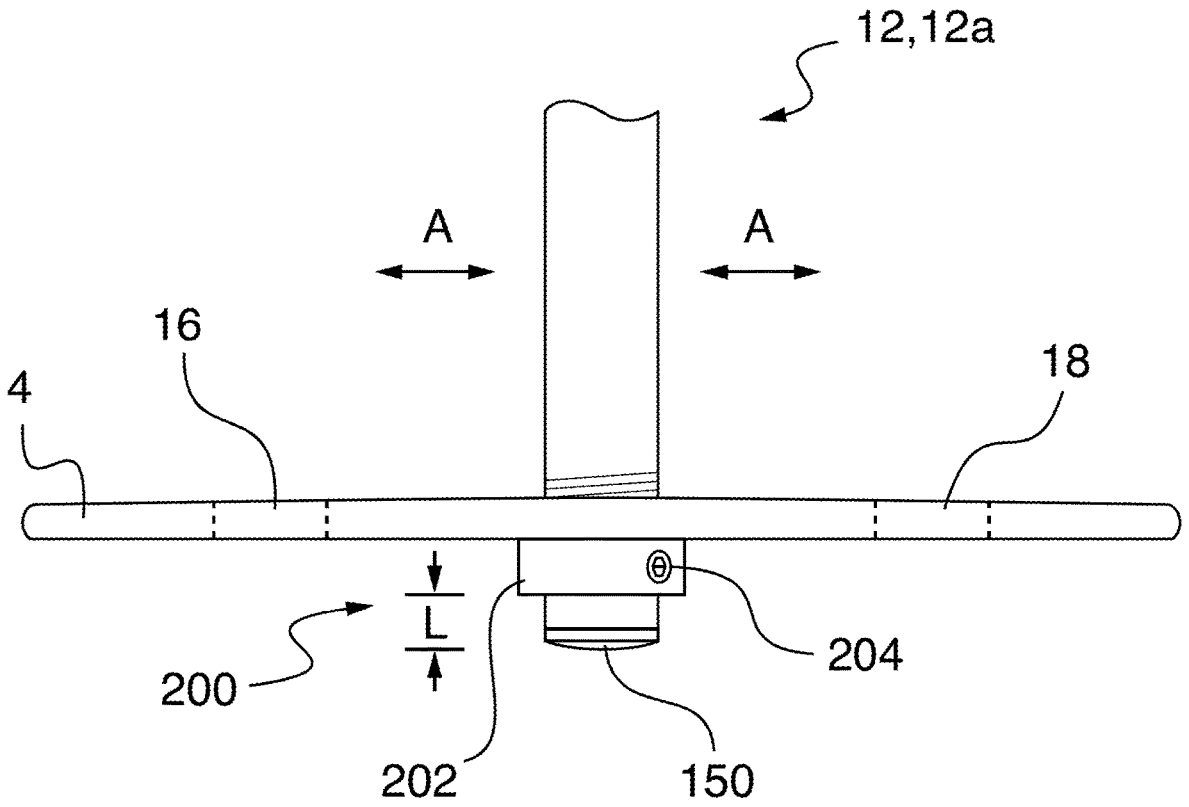
FIG. 9 is a schematic illustration of another embodiment of the mobile, free standing field sport shooting target device, constructed according to the present invention.
Figure 10:
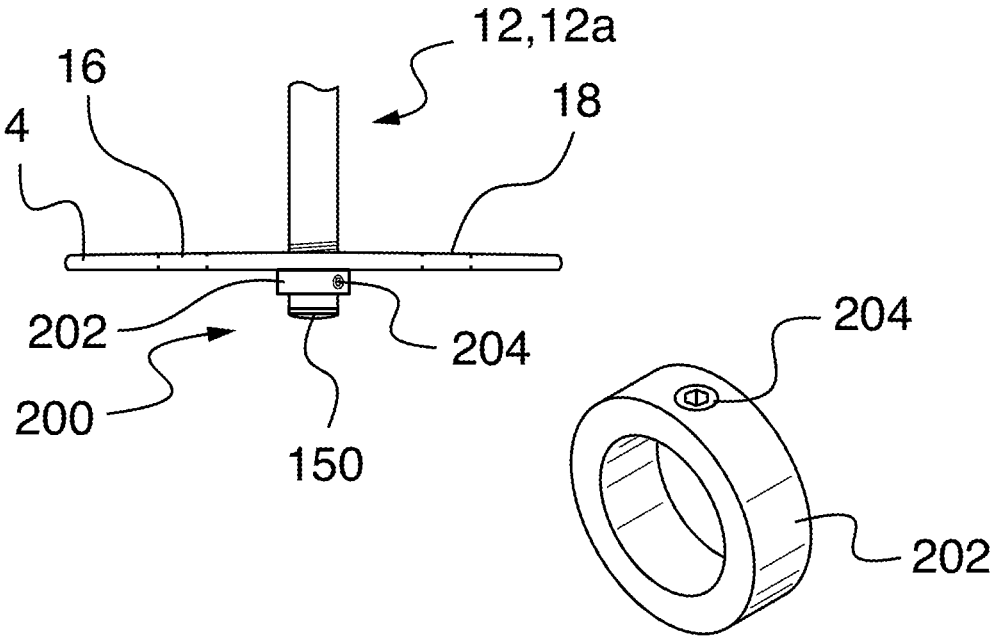
FIG. 10 is a schematic illustration of the shaft collar with a set screw, constructed according to another embodiment of the present invention.

Regarding FIGS. 9 and 10, there is illustrated another embodiment of the mobile, free standing field sport shooting target device 200. Mobile, free standing field sport shooting target device 200 includes, in part, counter weight plate 4, pole (goalpole) 12,12*a* having goalpole end cap 150, openings 16 and 18, shaft collar 202, and set screw 204. It is to be understood that pole (goalpole) 12,12*a* is constructed in a similar manner as discussed above with respect to FIGS. 1-5. In particular, pole (goalpole) 12,12*a* will include an opening 14, 14*a* (FIG. 1) that will allow a ball 102 (FIG. 3) to be placed on the opening. Preferably, shaft collar 202 and set screw 204 are constructed of any suitable, durable, rigid, UV resistant, and high strength material.

A unique aspect of the present invention is the use of shaft collar 202 and set screw 204. As shown in FIGS. 9 and 10, a desired length (L) of pole (goalpole) 12,12*a* below counter weight plate 4 is determined. The length of pole (goalpole) 12,12*a* can be adjusted in order to adjust the amount of teeter in mobile, free standing field sport shooting target device 200. In particular, a longer length (L) will typically cause a greater amount of teeter of mobile, free standing field sport shooting target device 200 than a shorter length (L). Preferably, the length (L) should be around 1-3 inches. Once the desired length (L) has been determined, the user locates the shaft collar 202 over the end of pole (goalpole) 12,12*a* and conventionally manipulates set screw 204 so that set screw 204 contacts a portion of the end of pole (goalpole) 12,12*a* in order to securely retain shaft collar 202 on pole (goalpole) 12,12*a*. It is to be understood that counter weight plate 4 rests on top of shaft collar 202 and is retained in place by the retention of shaft collar 202 on pole (goalpole) 12,12*a*.

During the operation of mobile, free standing field sport shooting target device 200, as discussed above, it is to be understood that if the ball contacts the poles 12 and/or 12*a* with the proper amount of force, the poles 12 and/or 12*a* should teeter along the direction of arrows A-A (FIG. 9), which should cause the ball(s) to become dislodged from poles 12 and/or 12*a* and fall off of poles 12 and/or 12*a*. Furthermore, as poles 12 and/or 12*a* teeter along the direction of arrows A-A (FIG. 9), goalpole end cap 150 allows goalpole 12, 12*a* to rock back and forth (teeter) on goalpole end cap 150, as discussed above. Also, as discussed above, when the ball contacts the poles 12 and/or 12*a*, an audible sound should be emitted from the poles 12 and/or 12*a*.

Figure 11:
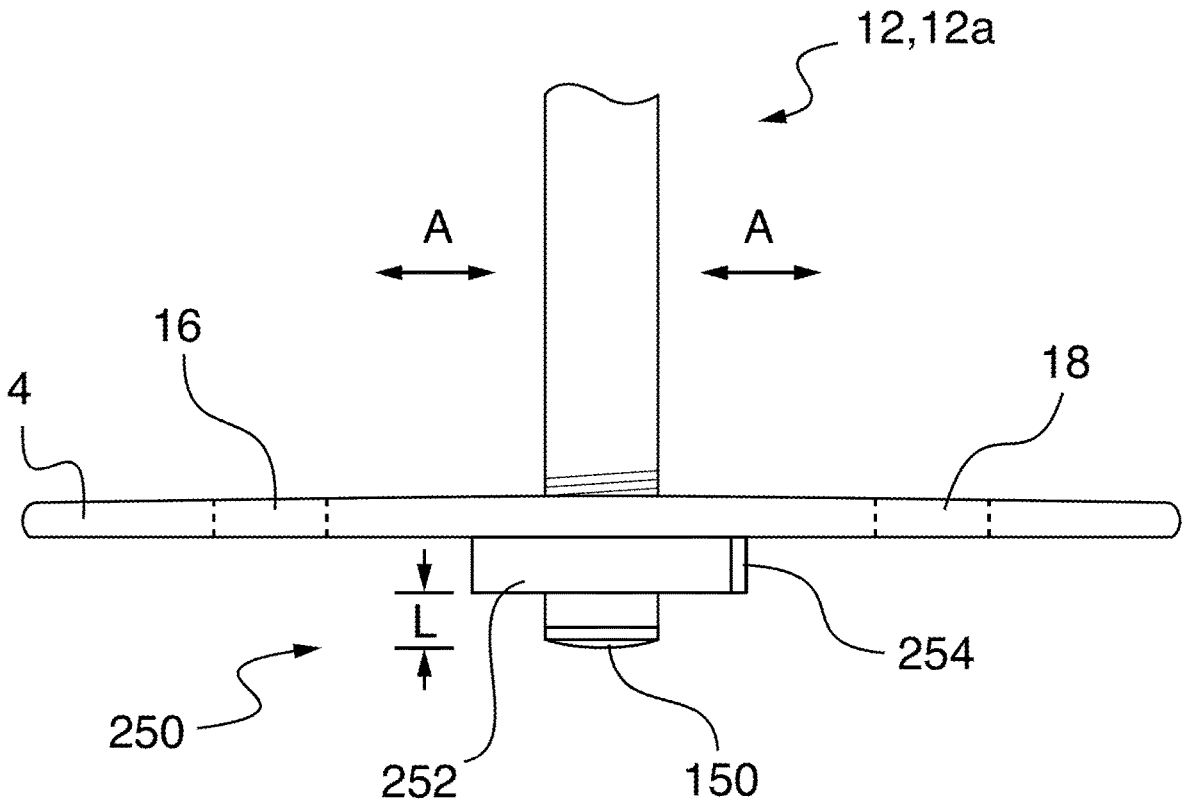
FIG. 11 is a schematic illustration of another embodiment of the mobile, free standing field sport shooting target device, constructed according to the present invention.
Figure 12:
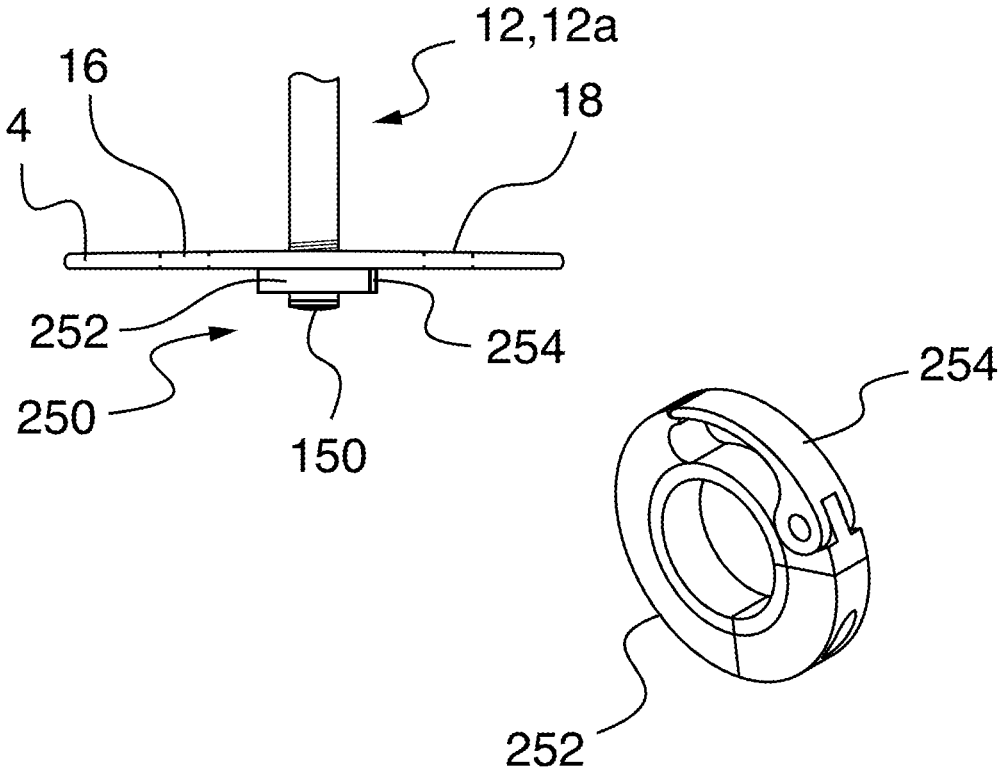
FIG. 12 is a schematic illustration of a shaft collar with a cam lock, constructed according to another embodiment of the present invention.

Regarding FIGS. 11 and 12, there is illustrated another embodiment of the mobile, free standing field sport shooting target device 250. Mobile, free standing field sport shooting target device 250 includes, in part, counter weight plate 4, pole (goalpole) 12,12*a* having goalpole end cap 150, openings 16 and 18, shaft collar 252, and cam lock 254. It is to be understood that pole (goalpole) 12,12*a* is constructed in a similar manner as discussed above with respect to FIGS. 1-5. In particular, pole (goalpole) 12,12*a* will include an opening that will allow a ball to be placed on the opening. Preferably, shaft collar 252 and cam lock 254 are constructed of any suitable, durable, rigid, UV resistant, and high strength material.

A unique aspect of the present invention is the use of shaft collar 252 and cam lock 254. As shown in FIGS. 11 and 12, a desired length (L) of pole (goalpole) 12,12*a* below counter weight plate 4 is determined. The length of pole (goalpole) 12,12*a* can be adjusted in order to adjust the amount of teeter in mobile, free standing field sport shooting target device 250. In particular, a longer length (L) will typically cause a greater amount of teeter of mobile, free standing field sport shooting target device 250 than a shorter length (L). Preferably, the length (L) should be around 1-3 inches. Once the desired length (L) has been determined, the user locates the shaft collar 252 over the end of pole (goalpole) 12,12*a* and conventionally manipulates cam lock 254 so that cam lock 254 causes shaft collar 252 to firmly contact a portion of the end of pole (goalpole) 12,12*a* in order to securely retain shaft collar 252 on pole (goalpole) 12,12*a*. It is to be understood that counter weight plate 4 rests on top of shaft collar 252 and is retained in place by the retention of shaft collar 252 on pole (goalpole) 12,12*a*.

During the operation of mobile, free standing field sport shooting target device 250, as discussed above, it is to be understood that if the ball contacts the poles 12 and/or 12*a* with the proper amount of force, the poles 12 and/or 12*a* should teeter along the direction of arrows A-A (FIG. 11), which should cause the ball(s) to become dislodged from poles 12 and/or 12*a* and fall off of poles 12 and/or 12*a*. Furthermore, as poles 12 and/or 12*a* teeter along the direction of arrows A-A (FIG. 11), goalpole end cap 150 allows goalpole 12, 12*a* to rock back and forth (teeter) on goalpole end cap 150, as discussed above. Also, as discussed above, when the ball contacts the poles 12 and/or 12*a*, an audible sound should be emitted from the poles 12 and/or 12*a*.

Figure 13:
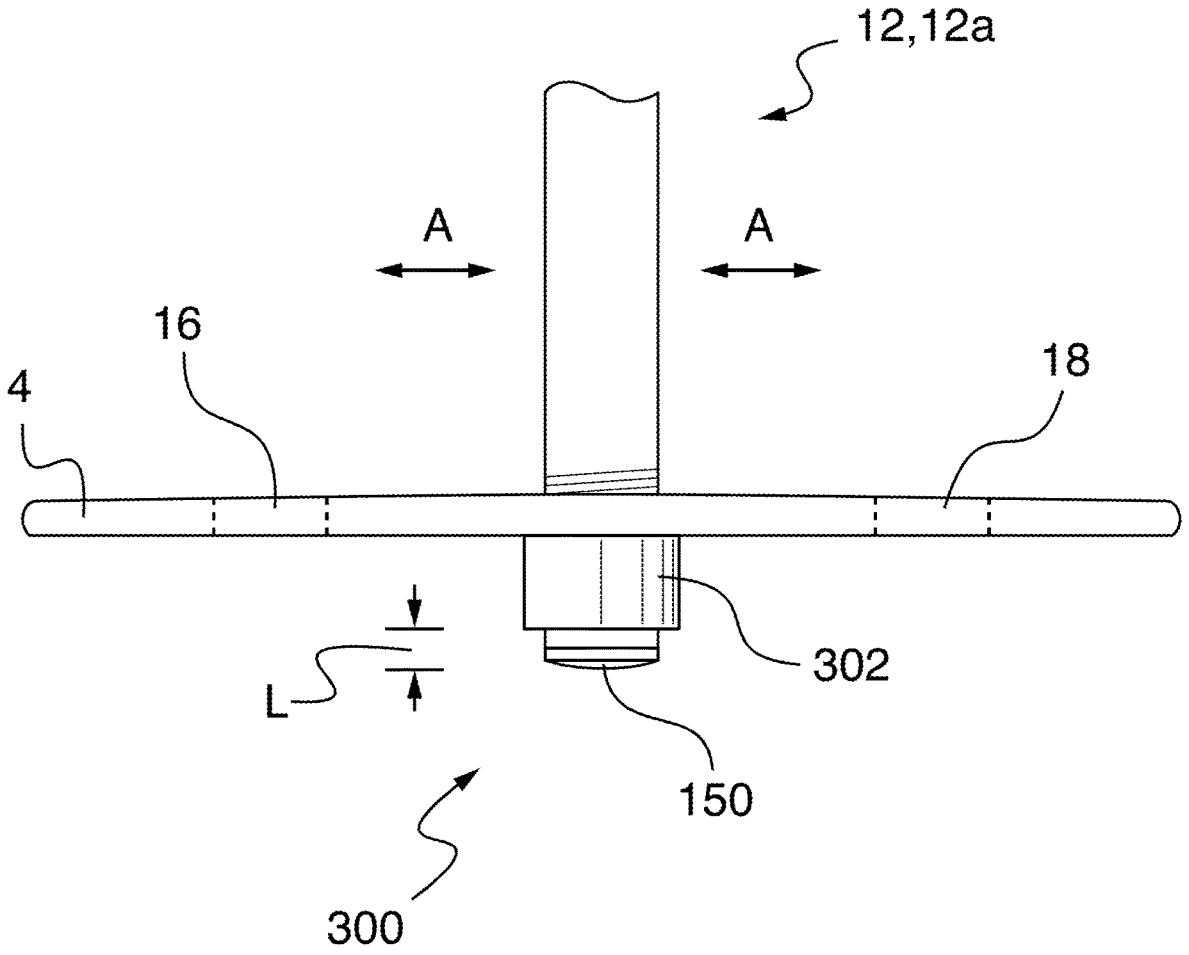
FIG. 13 is a schematic illustration of another embodiment of the mobile, free standing field sport shooting target device, constructed according to the present invention.
Figure 14:
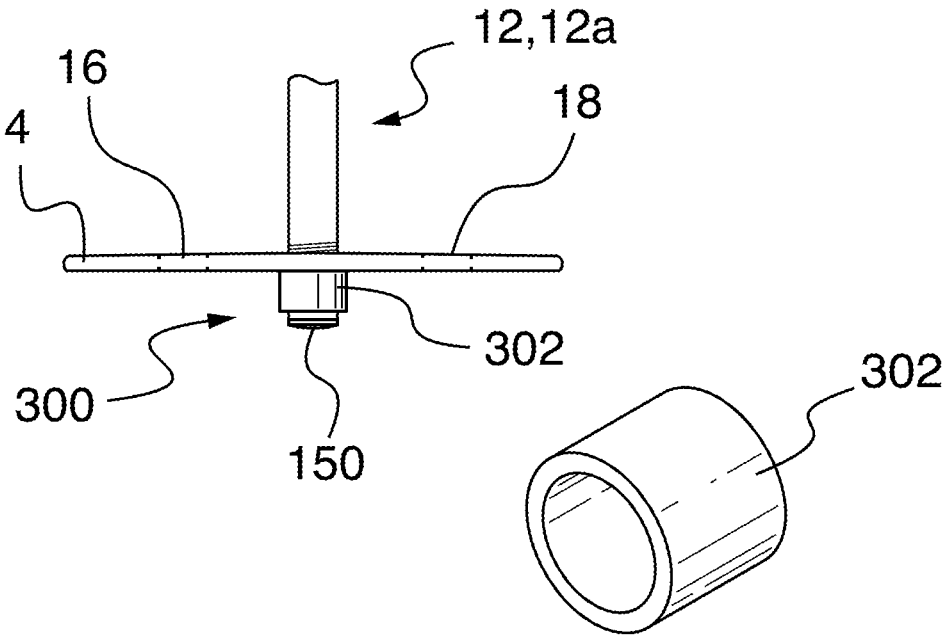
FIG. 14 is a schematic illustration of a fixed collar, constructed according to another embodiment of the present invention.

Regarding FIGS. 13 and 14, there is illustrated another embodiment of the mobile, free standing field sport shooting target device 300. Mobile, free standing field sport shooting target device 300 includes, in part, counter weight plate 4, pole (goalpole) 12,12*a* having goalpole end cap 150, openings 16 and 18, and shaft collar 302. It is to be understood that pole (goalpole) 12,12*a* is constructed in a similar manner as discussed above with respect to FIGS. 1-5. In particular, pole (goalpole) 12,12*a* will include an opening that will allow a ball to be placed on the opening. Preferably, shaft collar 302 is constructed of any suitable, durable, rigid, UV resistant, and high strength material.

A unique aspect of the present invention is the use of shaft collar 302. As shown in FIGS. 13 and 14, a desired length (L) of pole (goalpole) 12,12*a* below counter weight plate 4 is determined. The length of pole (goalpole) 12,12*a* can be adjusted in order to adjust the amount of teeter in mobile, free standing field sport shooting target device 300. In particular, a longer length (L) will typically cause a greater amount of teeter of mobile, free standing field sport shooting target device 300 than a shorter length (L). Preferably, the length (L) should be around 1-3 inches. Once the desired length (L) has been determined, the user locates the shaft collar 302 over the end of pole (goalpole) 12,12*a* and conventionally attaches shaft collar 302 to a portion of the end of pole (goalpole) 12,12*a* so that shaft collar 302 is connected to a portion of the end of pole (goalpole) 12,12*a* in order to securely retain shaft collar 302 on pole (goalpole) 12,12*a*. It is to be understood that shaft collar 302 can be attached to the end of pole (goalpole) 12,12*a* by conventional techniques such as adhesives, fasteners, or the like. It is to be further understood that counter weight plate 4 rests on top of shaft collar 302 and is retained in place by the retention of shaft collar 302 on pole (goalpole) 12,12*a*.

During the operation of mobile, free standing field sport shooting target device 300, as discussed above, it is to be understood that if the ball contacts the poles 12 and/or 12*a* with the proper amount of force, the poles 12 and/or 12*a* should teeter along the direction of arrows A-A (FIG. 13), which should cause the ball(s) to become dislodged from poles 12 and/or 12*a* and fall off of poles 12 and/or 12*a*. Furthermore, as poles 12 and/or 12*a* teeter along the direction of arrows A-A (FIG. 11), goalpole end cap 150 allows goalpole 12, 12*a* to rock back and forth (teeter) on goalpole end cap 150, as discussed above. Also, as discussed above, when the ball contacts the poles 12 and/or 12*a*, an audible sound should be emitted from the poles 12 and/or 12*a*.

Figure 15:
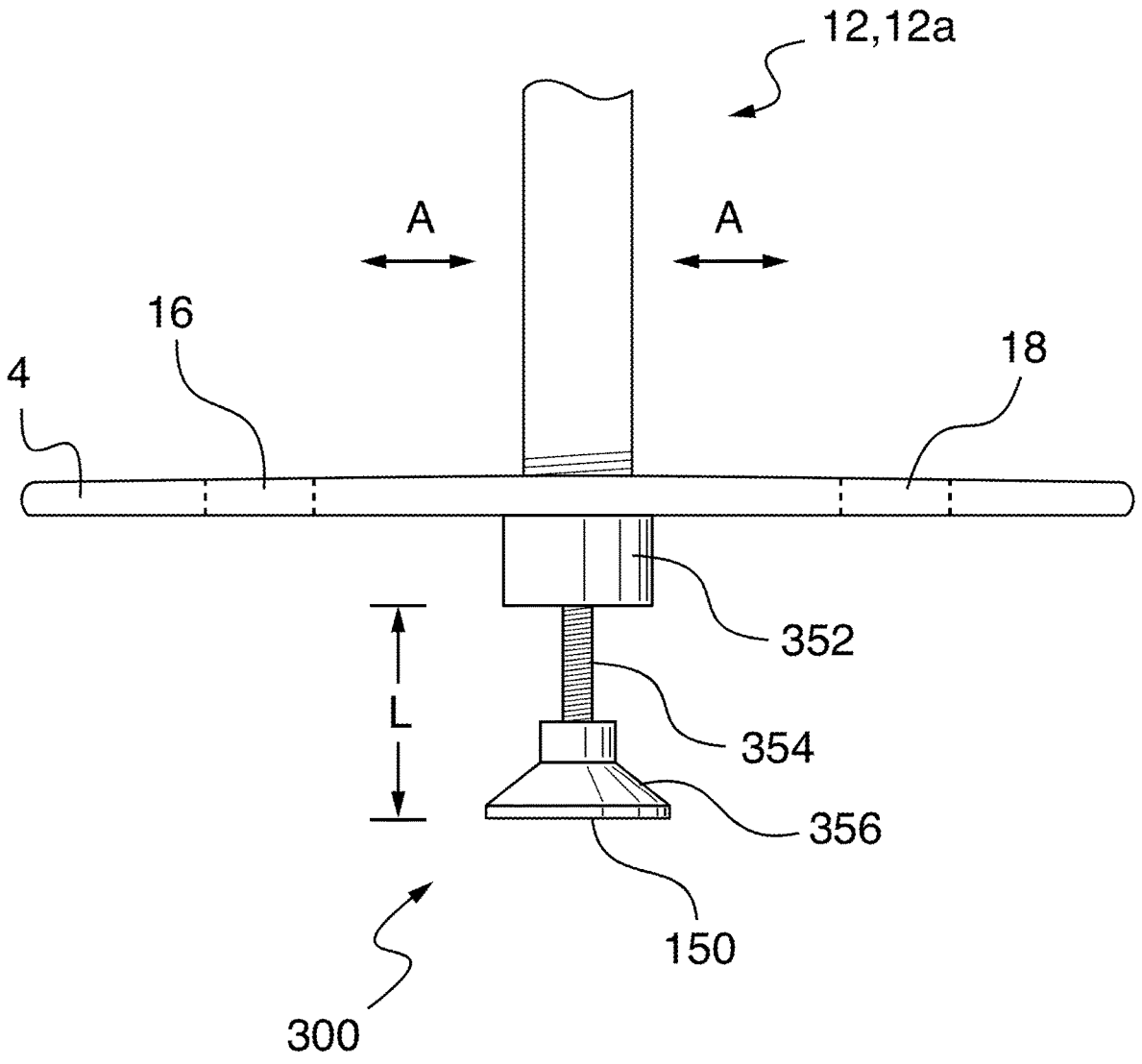
FIG. 15 is a schematic illustration of another embodiment of the mobile, free standing field sport shooting target device, constructed according to the present invention.
Figure 16:
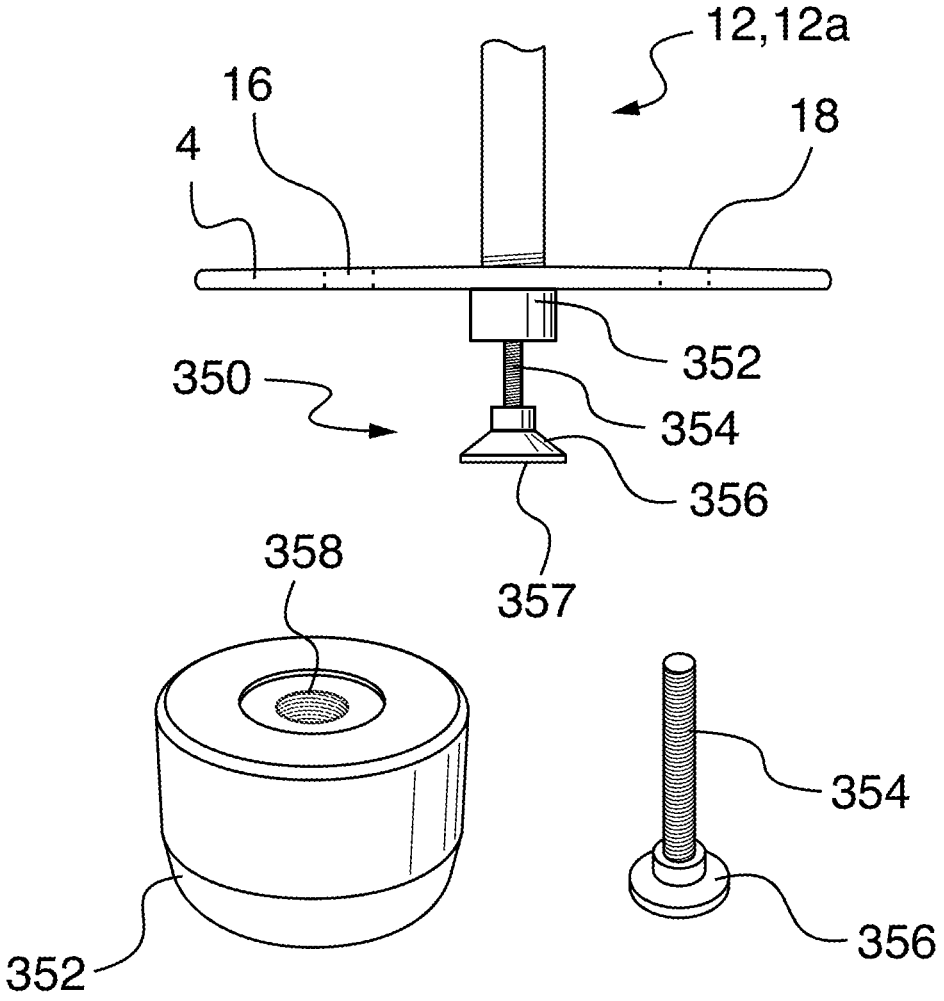
FIG. 16 is a schematic illustration of a shaft collar and a threaded foot, constructed according to another embodiment of the present invention.

Regarding FIGS. 15 and 16, there is illustrated another embodiment of the mobile, free standing field sport shooting target device 350. Mobile, free standing field sport shooting target device 350 includes, in part, counter weight plate 4, pole (goalpole) 12,12*a*, openings 16 and 18, foot mount 352, threaded leg 354, and foot 356. It is to be understood that pole (goalpole) 12,12*a* is constructed in a similar manner as discussed above with respect to FIGS. 1-5. In particular, pole (goalpole) 12,12*a* will include an opening that will allow a ball to be placed on the opening. Preferably, foot mount 352, threaded leg 354, and foot 356 are constructed of any suitable, durable, rigid, UV resistant, and high strength material. It is to be understood that in this embodiment, foot 356 includes a flat base 357.

A unique aspect of the present invention is the use of foot mount 352, threaded leg 354, and foot 356. The user locates the foot mount 352 over the end of pole (goalpole) 12,12*a* and conventionally attaches foot mount 352 to a portion of the end of pole (goalpole) 12,12*a* so that foot mount 352 is connected to a portion of the end of pole (goalpole) 12,12*a* in order to securely retain foot mount 352 on pole (goalpole) 12,12*a*. It is to be understood that foot mount 352 can be attached to the end of pole (goalpole) 12,12*a* by conventional techniques such as adhesives, fasteners, or the like. It is to be further understood that counter weight plate 4 rests on top of foot mount 352 and is retained in place by the retention of foot mount 352 on pole (goalpole) 12,12*a*. The threaded leg 354 is then conventionally threaded at one end into the opening 358 (FIG. 16) in foot mount 354 and the other end of threaded leg 354 is conventionally threaded onto foot 356.

As shown in FIGS. 15 and 16, a desired length (L) of pole (goalpole) 12,12*a* below counter weight plate 4 is determined. The length of pole (goalpole) 12,12*a* can be adjusted by rotating the threaded leg 354 so that a distance between foot mount 352 and foot 356 can be adjusted in order to adjust the amount of teeter in mobile, free standing field sport shooting target device 350. In particular, a longer length (L) will typically cause a greater amount of teeter of mobile, free standing field sport shooting target device 350 than a shorter length (L). Preferably, the length (L) should be around 1-3 inches.

During the operation of mobile, free standing field sport shooting target device 350, as discussed above, it is to be understood that if the ball contacts the poles 12 and/or 12*a* with the proper amount of force, the poles 12 and/or 12*a* should teeter along the direction of arrows A-A (FIG. 13), which should cause the ball(s) to become dislodged from poles 12 and/or 12*a* and fall off of poles 12 and/or 12*a*. Furthermore, as poles 12 and/or 12*a* teeter along the direction of arrows A-A (FIG. 13), foot 356 allows goalpole 12, 12*a* to rock back and forth (teeter) on foot 356 in a similar manner as discussed above. Also, as discussed above, when the ball contacts the poles 12 and/or 12*a*, an audible sound should be emitted from the poles 12 and/or 12*a*.

Figure 17:
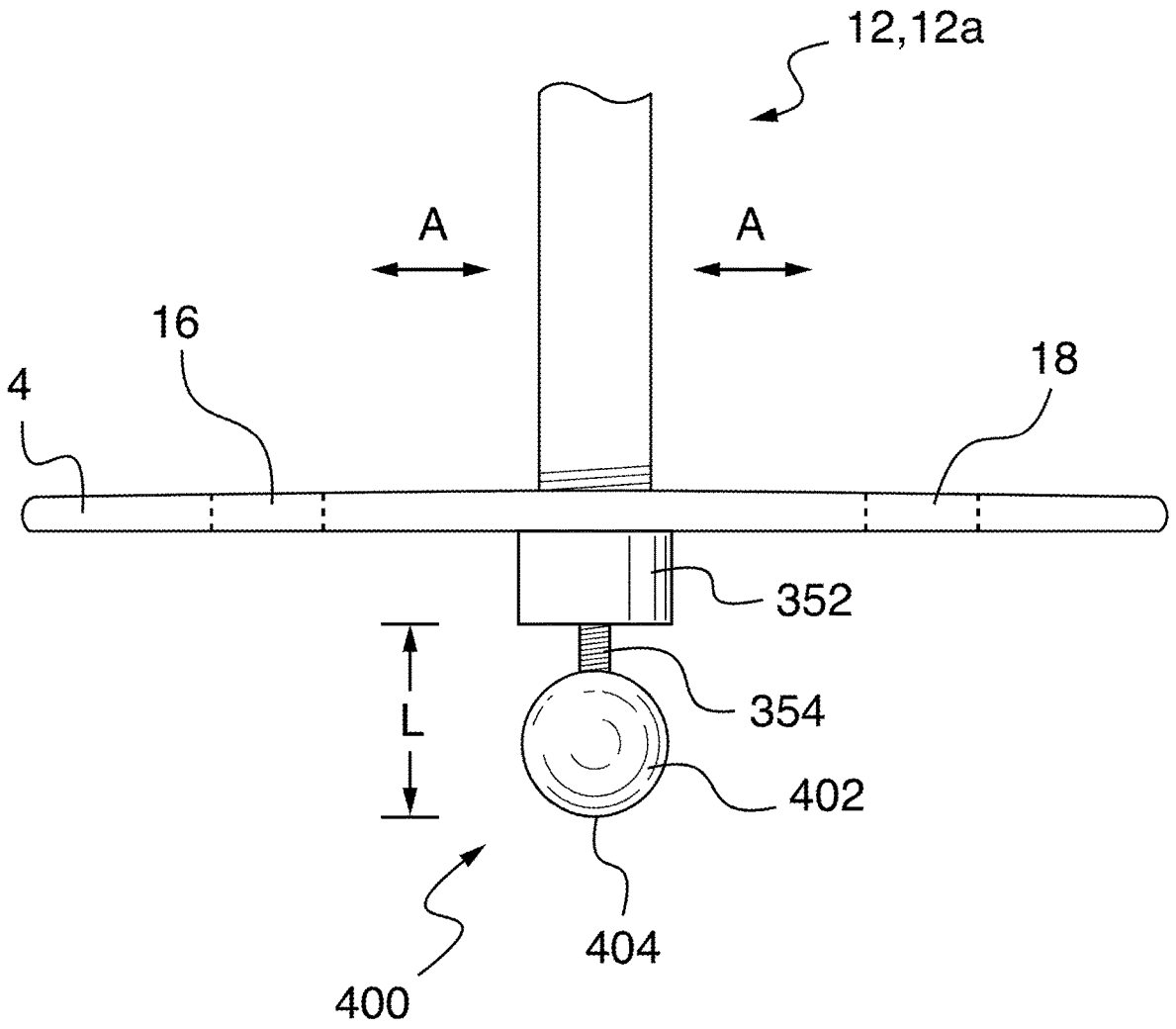
FIG. 17 is a schematic illustration of a shaft collar and another embodiment of a threaded foot, constructed according to the present invention.

Regarding FIG. 17, there is illustrated another embodiment of the mobile, free standing field sport shooting target device 400. Mobile, free standing field sport shooting target device 400 includes, in part, counter weight plate 4, pole (goalpole) 12,12*a*, openings 16 and 18, foot mount 352, threaded leg 354, and foot 402. It is to be understood that pole (goalpole) 12,12*a* is constructed in a similar manner as discussed above with respect to FIGS. 1-5. In particular, pole (goalpole) 12,12*a* will include an opening that will allow a ball to be placed on the opening. Preferably, foot mount 352, threaded leg 354, and foot 402 are constructed of any suitable, durable, rigid, UV resistant, and high strength material. It is to be understood that in this embodiment, foot 402 includes a ball-shaped base 404.

A unique aspect of the present invention is the use of foot mount 352, threaded leg 354, and foot 402. The user locates the foot mount 352 over the end of pole (goalpole) 12,12*a* and conventionally attaches foot mount 352 to a portion of the end of pole (goalpole) 12,12*a* so that foot mount 352 is connected to a portion of the end of pole (goalpole) 12,12*a* in order to securely retain foot mount 352 on pole (goalpole) 12,12*a*. It is to be understood that foot mount 352 can be attached to the end of pole (goalpole) 12,12*a* by conventional techniques such as adhesives, fasteners, or the like. It is to be further understood that counter weight plate 4 rests on top of foot mount 352 and is retained in place by the retention of foot mount 352 on pole (goalpole) 12,12*a*. The threaded leg 354 is then conventionally threaded at one end into the opening 358 (FIG. 16) in foot mount 354 and the other end of threaded leg 354 is conventionally threaded onto foot 402.

As shown in FIG. 17, a desired length (L) of pole (goalpole) 12,12*a* below counter weight plate 4 is determined. The length of pole (goalpole) 12,12*a* can be adjusted by rotating the threaded leg 354 so that a distance between foot mount 352 and foot 402 can be adjusted in order to adjust the amount of teeter in mobile, free standing field sport shooting target device 400. In particular, a longer length (L) will typically cause a greater amount of teeter of mobile, free standing field sport shooting target device 400 than a shorter length (L). Preferably, the length (L) should be around 1-3 inches.

During the operation of mobile, free standing field sport shooting target device 400, as discussed above, it is to be understood that if the ball contacts the poles 12 and/or 12*a* with the proper amount of force, the poles 12 and/or 12*a* should teeter along the direction of arrows A-A (FIG. 13), which should cause the ball(s) to become dislodged from poles 12 and/or 12*a* and fall off of poles 12 and/or 12*a*. Furthermore, as poles 12 and/or 12*a* teeter along the direction of arrows A-A (FIG. 11), foot 402 allows goalpole 12, 12*a* to rock back and forth (teeter) on foot 402 in a similar manner as discussed above. Also, as discussed above, when the ball contacts the poles 12 and/or 12*a*, an audible sound should be emitted from the poles 12 and/or 12*a*.

Figure 18:
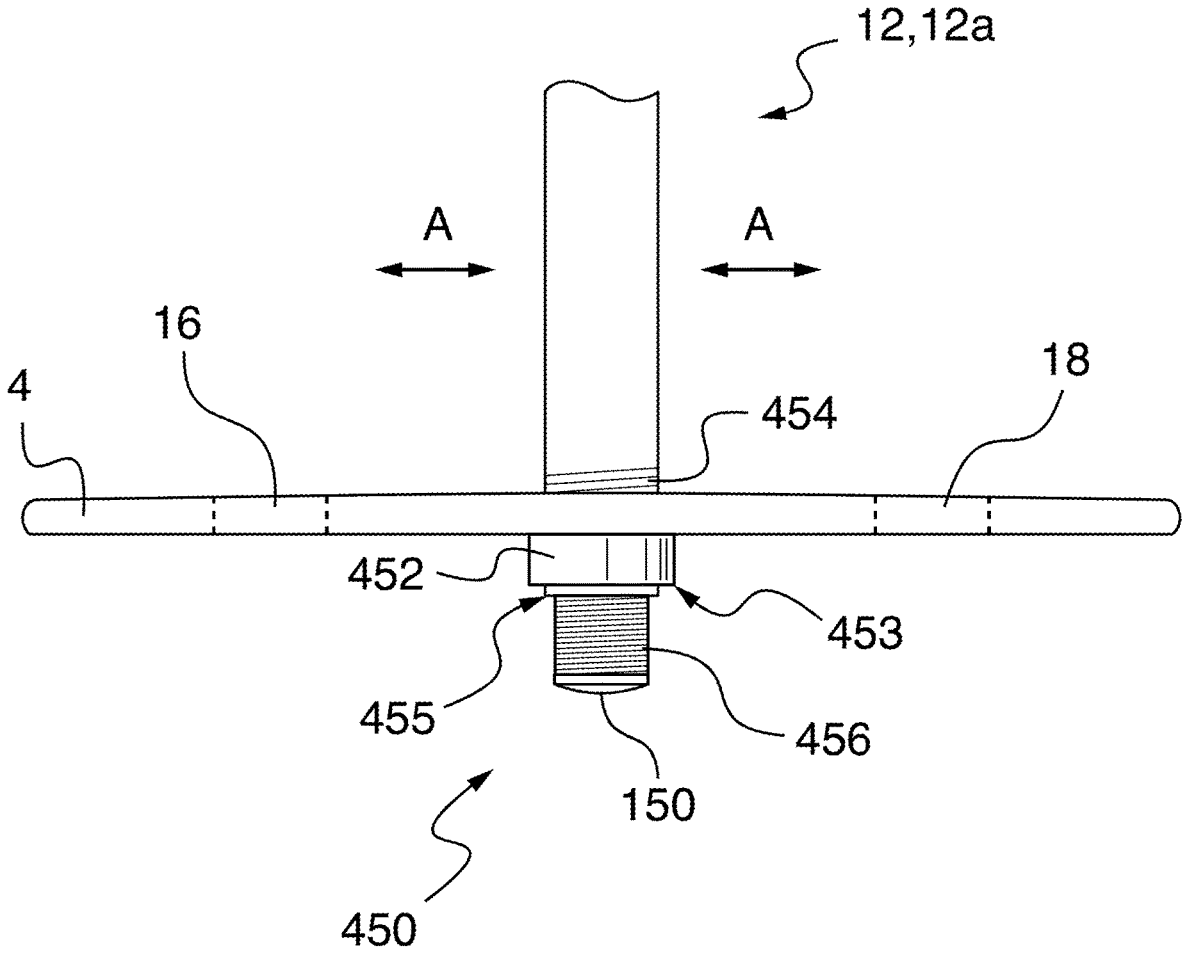
FIG. 18 is a schematic illustration of another embodiment of the mobile, free standing field sport shooting target device, constructed according to the present invention.

Regarding FIG. 18, there is illustrated another embodiment of the mobile, free standing field sport shooting target device 450. Mobile, free standing field sport shooting target device 450 includes, in part, counter weight plate 4, pole (goalpole) 12,12*a*, openings 16 and 18, shaft collar 452, threaded extension 456, and goalpole end cap 150. It is to be understood that pole (goalpole) 12,12*a* is constructed in a similar manner as discussed above with respect to FIGS. 1-5. In particular, pole (goalpole) 12,12*a* will include an opening that will allow a ball to be placed on the opening. Preferably, shaft collar 452 and threaded extension 456 are constructed of any suitable, durable, rigid, UV resistant, and high strength material.

A unique aspect of the present invention is the use of shaft collar 452 and threaded extension 456. The user threads the shaft collar 452 over the end of pole (goalpole) 12,12*a* and conventionally attaches shaft collar 452 to a threaded portion 454 located on the outside of the end of pole (goalpole) 12,12*a* so that shaft collar 452 is connected to a portion of the end of pole (goalpole) 12,12*a* in order to securely retain shaft collar 452 on pole (goalpole) 12,12*a*. It is to be understood that the end of pole (goalpole) 12,12*a* is conventionally constructed with the threaded portion 454 on the outside of the end of pole (goalpole) 12,12*a* and shaft collar 452 is conventionally constructed with a threaded portion 453 on the inside of shaft collar 452 so that shaft collar 452 can be attached to the outside of the end of pole (goalpole) 12,12*a* through the interaction of threaded portions 453 and 454. Furthermore, the end of pole (goalpole) 12,12*a* is also conventionally constructed with a threaded portion 455 on the inside of the end of pole (goalpole) 12,12*a* so that threaded extension 456 can be attached to the inside of the end of pole (goalpole) 12,12*a*. It is to be further understood that counter weight plate 4 rests on top of shaft collar 452 and is retained in place by the retention of shaft collar 452 on pole (goalpole) 12,12*a*. The threaded extension 456 is then conventionally threaded at one end into the end of pole (goalpole) 12,12*a* so that threaded extension 456 interacts with threaded portion 455 on the inside of the end of pole (goalpole) 12,12*a*.

As shown in FIG. 18, a desired length (L) of pole (goalpole) 12,12*a* below counter weight plate 4 is determined. The length of pole (goalpole) 12,12*a* can be adjusted by rotating the threaded extension 456 so that a distance between shaft collar 452 and goalpole end cap 150 can be adjusted in order to adjust the amount of teeter in mobile, free standing field sport shooting target device 450. In particular, a longer length (L) will typically cause a greater amount of teeter of mobile, free standing field sport shooting target device 450 than a shorter length (L). Preferably, the length (L) should be around 1-3 inches.

During the operation of mobile, free standing field sport shooting target device 450, as discussed above, it is to be understood that if the ball contacts the poles 12 and/or 12*a* with the proper amount of force, the poles 12 and/or 12*a* should teeter along the direction of arrows A-A (FIG. 18), which should cause the ball(s) to become dislodged from poles 12 and/or 12*a* and fall off of poles 12 and/or 12*a*. Furthermore, as poles 12 and/or 12*a* teeter along the direction of arrows A-A (FIG. 18), goalpole end cap 150 allows goalpole 12, 12*a* to rock back and forth (teeter) in a similar manner as discussed above. Also, as discussed above, when the ball contacts the poles 12 and/or 12*a*, an audible sound should be emitted from the poles 12 and/or 12*a*.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety.

The applicant reserves the right to physically incorporate into this specification any and all materials and information from any such patents, publications, scientific articles, web sites, electronically available information, and other referenced materials or documents to the extent such incorporated materials and information are not inconsistent with the description herein.

All of the features disclosed in this specification may be combined in any combination. Thus, unless expressly stated otherwise, each feature disclosed is only an example of a generic series of equivalent or similar features.

The specific methods and compositions described herein are representative of preferred embodiments and are exemplary and not intended as limitations on the scope of the invention. Other objects, aspects, and embodiments will occur to those skilled in the art upon consideration of this specification and are encompassed within the spirit of the invention. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

Other modifications and implementations will occur to those skilled in the art without departing from the spirit and the scope of the invention. Accordingly, the description hereinabove is not intended to limit the invention.

Therefore, provided herein is a new and improved mobile, free standing field sport shooting target device for use in such sports as lacrosse. The preferred mobile, free standing field sport shooting target device, according to various embodiments of the present invention, offers the following advantages: ease of use; reduced cost; portability; lightness in weight; durability; compactness of the device; improved safety; improved shooting training characteristics; the ability to hear when the ball contacts the device; the ability to provide different heights of the device; the ability to allow the device to teeter; the ability to be free standing; provides a three-dimensional, functional bounce shooting target; provides a training tool for small sided lacrosse games; ease of packing the device; and ease of carrying the device.

In fact, in many of the preferred embodiments, these advantages of ease of use, reduced cost, portability, lightness in weight, durability, compactness of the device, improved safety, improved shooting training characteristics, the ability to hear when the ball contacts the device, the ability to provide different heights of the device, the ability to allow the device to teeter, the ability to be free standing, provides a three-dimensional, functional bounce shooting target, provides a training tool for small sided lacrosse games, ease of packing the device, and ease of carrying the device are optimized to an extent that is considerably higher than heretofore achieved in prior, known training devices to improve the shooting skills of an athlete.

What is claimed is:

1. A mobile, free standing field sport shooting target system, comprising a target device comprising:

a pole having a first end and a second end, wherein an opening is located at the first and second ends of the pole and an end cap is operatively connected to the opening at the first end of the pole;

a counter weight plate having a plurality of openings, wherein the counter weight plate is located adjacent to the first end of the pole, and wherein the counter weight plate causes the pole to be retained in an upright position;

a collar operatively connected to the first end of the pole, wherein the collar has a first end and a second end such that the counter weight plate is located adjacent to the first end of the collar, the collar is used to retain the counter weight plate on the first end of the pole, and the collar and the first end of the pole extend below the counter weight plate to allow the target device to move back and forth on the end cap, and wherein a distance between the end cap and a bottom side of the counter weight plate can be adjusted by an interaction between the collar and the first end of the pole in order to adjust an amount of back and forth movement of the target device;

a first ball located on the second end of the pole; and a second ball that is capable of being propelled towards the target device in order to knock the first ball off of the pole.

2. The target system, according to claim 1, wherein the opening located at the second end of the pole is sized so as to be capable of retaining the first ball.

3. The target system, according to claim 1, wherein the collar further comprises:

a set screw located between the first and second ends of the collar.

4. The target system, according to claim 1, wherein the collar further comprises:

a cam lock operatively connected to the collar.

5. The target system, according to claim 1, wherein the target device further comprises:

a threaded portion located on the outside of the first end of the pole;

a threaded portion located in the opening at the first end of the pole;

a threaded portion located on the inside of the collar, such that the threaded portion located on the outside of the first end of the pole and the threaded portion located on the inside of the collar are used to retain the collar on the first end of the pole; and a threaded extension having the end cap located on a first end of the threaded extension and a threaded portion located on the outside of the threaded extension, such that the threaded portion located on the outside of the threaded extension and the threaded portion located in the opening at the first end of the pole are used to operatively connect the end cap to the opening at the first end of the pole, and wherein the threaded portion located on the outside of the threaded extension and the threaded portion located in the opening at the first end of the pole are used to adjust a distance between the bottom side of the counter weight plate and the end cap.

6. The target system, according to claim 1, wherein the pole is constructed of a material that is capable of creating a sound when contacted by an object.

7. A sport shooting target practice device, comprising:

a pole having a first end and a second end, wherein an opening is located at the first and second ends of the pole;

a counter weight plate having a plurality of openings, wherein the counter weight plate is located adjacent to the first end of the pole, and wherein the counter weight plate causes the pole to be retained in an upright position;

a foot mount operatively connected to the first end of the pole, wherein the foot mount has a first end and a second end such that the counter weight plate is located adjacent to the first end of the foot mount, the foot mount is used to retain the counter weight plate on the first end of the pole;

a foot rotatably connected to the second end of the foot mount, wherein the foot mount extends below the counter weight plate to allow the sport shooting target practice device to move back and forth on the foot and wherein a distance between a bottom side of the counter weight plate and the foot can be adjusted by an interaction between the foot and the second end of the foot mount in order to adjust an amount of back and forth movement of the sport shooting target practice device;

a first ball located on the second end of the pole; and a second ball that is capable of being propelled towards the sport shooting target practice device in order to knock the first ball off of the pole.

8. The sport shooting target practice device, according to claim 7, wherein the sport shooting target practice device further comprises:

a threaded leg having a first end and a second end, such that the first end of the threaded leg is operatively connected to an opening in the second end of the foot mount; and the foot is operatively connected to the second end of the threaded leg.

9. The sport shooting target practice device, according to claim 8, wherein the foot further comprises:

a flat base.

10. The sport shooting target practice device, according to claim 8, wherein the foot further comprises:

a ball-shaped base.

11. The sport shooting target practice device, according to claim 7, wherein the opening located at the second end of the pole is sized so as to be capable of retaining the first ball.

12. The sport shooting target practice device, according to claim 7, wherein the pole is constructed of a material that is capable of creating a sound when contacted by an object.

13. A method of constructing a mobile, free standing field sport shooting target device, comprising:

providing a pole having a first end and a second end, wherein an opening is located at the first and second ends of the pole and an end cap is operatively connected to the opening at the first end of the pole;

placing a counter weight plate adjacent to the first end of the pole, wherein the counter weight plate includes a plurality of openings, and wherein the counter weight plate causes the pole to be retained in an upright position;

attaching a collar to the first end of the pole, wherein the collar has a first end and a second end such that the counter weight plate is located adjacent to the first end of the collar, the collar is used to retain the counter weight plate on the first end of the pole, and the collar and the first end of the pole extend below the counter weight plate to allow the mobile, free standing field sport shooting target device to move back and forth on the end cap, and wherein a distance between the end cap and a bottom side of the counter weight plate can be adjusted by an interaction between the collar and the first end of the pole in order to adjust an amount of back and forth movement of the mobile, free standing field sport shooting target device;

locating a first ball on the second end of the pole; and providing a second ball that is capable of being propelled towards the mobile, free standing field sport shooting target device in order to knock the first ball off of the pole.

14. The method, according to claim 13, wherein the opening located at the second end of the pole is sized so as to be capable of retaining the first ball.

15. The method, according to claim 13, wherein the attaching the collar further comprises:

attaching a set screw between the first and second ends of the collar.

16. The method, according to claim 13, wherein the attaching the collar further comprises:

attaching a cam lock to the collar.

17. The method, according to claim 13, wherein the method further comprises:

providing a threaded portion located on the outside of the first end of the pole;

providing a threaded portion located in the opening at the first end of the pole;

providing a threaded portion located on the inside of the collar, such that the threaded portion located on the outside of the first end of the pole and the threaded portion located on the inside of the collar are used to retain the collar on the first end of the pole; and providing a threaded extension having the end cap located on a first end of the threaded extension and a threaded portion located on the outside of the threaded extension, such that the threaded portion located on the outside of the threaded extension and the threaded portion located in the opening at the first end of the pole are used to operatively connect the end cap to the opening at the first end of the pole, and wherein the threaded portion located on the outside of the threaded extension and the threaded portion located in the opening at the first end of the pole are used to adjust the distance between the bottom side of the counter weight plate and the end cap.

18. The method, according to claim 13, wherein the pole is constructed of a material that is capable of creating a sound when contacted by an object.

* * * * *